United States Patent [19]

Starnes et al.

[11] 4,351,221

[45] Sep. 28, 1982

[54] PLAYER PIANO RECORDING SYSTEM

[75] Inventors: Roger L. Starnes; Ernest D. Henson; Thomas J. Wilkes, all of Lewisburg; James M. Sharp, Cornersville, all of Tenn.

[73] Assignee: Teledyne Industries, Incorporated, Los Angeles, Calif.

[21] Appl. No.: 48,938

[22] Filed: Jun. 15, 1979

[51] Int. Cl.³ ..... G10H 3/03; G10H 1/02; G10G 3/04; G10F 1/02

[52] U.S. Cl. ..... 84/1.28; 84/1.24; 84/1.1; 84/1.27; 84/21; 84/462

[58] Field of Search ..... 84/1.09, 1.1, 1.24, 84/1.27, 107, 115, 1.28, 462, DIG. 7, DIG. 19, 20–22

[56] References Cited

U.S. PATENT DOCUMENTS

| | | | |
|---|---|---|---|
| 3,049,957 | 8/1962 | Krug | 84/1.27 |
| 3,965,790 | 6/1976 | Suzuki et al. | 84/1.27 |
| 4,023,456 | 5/1977 | Groeschel | 84/115 |
| 4,067,253 | 1/1978 | Wheelwright et al. | 84/1.26 |
| 4,135,428 | 1/1979 | Campbell | 84/115 |
| 4,172,403 | 10/1979 | Campbell et al. | 84/1.28 |
| 4,174,652 | 11/1979 | Campbell | 84/1.28 |
| 4,176,578 | 12/1979 | Campbell et al. | 84/115 |

FOREIGN PATENT DOCUMENTS

| | | | |
|---|---|---|---|
| 2401838 | 7/1975 | Fed. Rep. of Germany | 84/1.1 |
| 5086527 | 1/1977 | Japan | 84/1.1 |
| 5087669 | 1/1977 | Japan | 84/1.1 |

*Primary Examiner*—J. V. Truhe
*Assistant Examiner*—Forester W. Isen
*Attorney, Agent, or Firm*—Jim Zegeer

[57] ABSTRACT

A player piano recording system has photosensor flags secured to the undersides of the piano keys, vertical movement of which is detected by horizontally adjustable photosensors to produce "key played" and key velocity signals which supplied to a microprocessor for deriving expression signals for recording on magnetic tape. The microprocessor provides output expression values and key play information. According to the invention, the expression values are a direct function of key velocity and key play information and switch selected boost (an enhanced initial frame expression for overcoming solenoid inertia) and add (for trill) values. Key play data is dependent upon key play inputs and the frame extension switch value. The unique structure of the key flag permits horizontal adjustment of the photosensors for vertical misalignments etc. of the piano keys. Player piano tapes prepared by use of the invention may be used directly to control player pianos or as master tapes for the production of commercial cassette tapes for consumer use with commercially available tape controlled player pianos.

15 Claims, 18 Drawing Figures

EXPRESSION ALGORITHM - 1 NEW KEY
VELOCITY COUNTS = 52
TABLE LOOK-UP EXPRESSION FOR 52 = 15

EXPRESSION ALGORITHM- 1 NEW KEY FRAME 10
MULTIPLE NEW KEYS FRAME - 20

ALGORITHM # = 10
FRAME 10→KEY 7 VELOCITY = 118 EXPR. = 4

| FRAME 20 KEY # | VELOCITY | EXPR. IN TABLE | RANKED EXPR. |
|---|---|---|---|
| 5 | 100 | 6 | 4 |
| 6 | 130 | 26 | 6 |
| 8 | 87 | 9 | 9 |
| 9 | 39 | 20 | 20 |
| 11 | 27 | 29 | 26 |
| 12 | 118 | 4 | 29 |

SINCE A NEW KEY WAS DETECTED IN THE PREVIOUS FRAME ONLY
1 GROUPING IS USED.
MEDIAN EXPR. = 20

EXPRESSION ALGORITHM - MULTIPLE NEW KEYS

ALGORITHM # = 10

| KEY # | VELOCITY | EXPRESSION IN TABLE |
|---|---|---|
| 5 | 100 | 6 |
| 6 | 30 | 26 |
| 8 | 87 | 9 |
| 9 | 39 | 20 |
| 11 | 27 | 29 |
| 12 | 118 | 4 |

(20 - 9) > 10
NO NEW KEYS IN PREVIOUS FRAME
∴ 2 GROUPS

| RANKED EXPRESSIONS |
|---|
| 4 |
| 6 |
| 9 |
| 20 |
| 26 |
| 29 |

GROUP 1
MEDIAN EXPR = 6

GROUP 2 MEDIAN EXPR. = 26

TRILLS

TRILL - A SHORT (4 FRAMES OR LESS) ON OR OFF TIME

TO DETECT A TRILL IN SOFTWARE - FIND 2 0→1 or 1→0 OCCURRENCES WITHIN 6 FRAMES.

TRILL FLAG & TRILL COUNTER

TRILL FLAG = 0 IF TRILL COUNTER = 0
= 1 IF TRILL COUNTER ≠ 0

TRILL COUNTER - SET TO 7 IF ANY TRILL IN ANY KEY IS DETECTED.
- DECREMENTED EACH FRAME AFTERWARDS EXCEPT IF ALREADY ZERO.

EFFECT OF TRILLS ON EXPRESSION (ADDING)

4 BIT ADD SWITCH VALUE = 5
NEW KEY IN FRAME 20 VELOCITY = 72 EXPR. FROM TALBE = 11
SINCE A TRILL HAS BEEN DETECTED EXPR. = EXPR. + SW. VALUE = 11 + 5 = 16

NEW KEY IN FRAME 90 VELOCITY = 45 EXPR. FROM TABLE = 17
TRILL FLAG IS IN EFFECT. HOWEVER EXPR. >15 ∴ ADD SWITCH VALUE IS DISREGARDED.
OUTPUT EXPR. = EXPR. FROM TABLE = 17

PLAYER PIANO RECORDING SYSTEM

DETAILED DESCRIPTION OF THE INVENTION

The present invention is directed to a player piano recording system and more particularly, a player piano recording system in which movement and velocity of each individual keys played are detected to produce key played and key velocity signals which are processed by commercially available microprocessors to produce recordable expression values which render the playback on the tape controlled player pianos and vorsetzer units of the highest quality heretofor attainable.

According to this invention the expression of each key is detected. The composite sound of all notes in a frame is computed in an algorithm by a microcomputer. The microcomputer then puts this data on digital cassette tape using the format disclosed in application Ser. No. 828,069 filed Aug. 26, 1977 in the name of J. M. Campbell, assigned to Teledyne Industries Inc., now U.S. Pat. No. 4,174,652 issued Nov. 20, 1979, and incorporated herein by reference. The loudness of a note is determined by the energy the hammer imparts to the string when it strikes the string. It is known in the art that a measure of the velocity of the hammer could be related to the energy since the hammer is in free flight when it strikes the string. In such system the sequential actuation of pair of switches was converted to expression information. However, the implementation of measuring the velocities of 80 hammers in a hammer bank of a conventional grand piano is clumsy and difficult and there is no room for vertical adjustment.

Since the piano key mechanism strikes the hammer and gives it its energy, if the motion of the key being depressed was duplicated, the energy given to the hammer would be the same. According to the invention a thin metal flag with a slot is mounted under the bottom of the key and used with a slotted optical LED sensor and emitter (designated a photosensor hereafter) to give an electrical pulse which indicated the amount of time it took the key to travel between two points in its downward motion. A sensor interface circuit counts the amount of time and presents this to the microcomputer or microprocessor. The circuit also has other features, one of which is that it ignores the electrical pulse from the sensors when the key travels back up to the rest position after being released.

In addition to the above velocity sensor, another sensor is used with the bottom edge of the flag to indicate whether or not the key is being held down. This information is important since the string dampers are held off if the key is held down allowing the note to continue to sound. This sensor is called key-played sensor since it is used to tell the microprocessor that a note is being played and for how long the note is played. The electrical signal from the key-played sensor also goes to the sensor interface circuit and is used to reset this circuit before each new note. There is one sensor interface circuit for each pair of velocity and key-played sensors, giving a total of 80 sensor interface circuits and 160 sensors for 80 keys on the keyboard.

The novelty of the flag design and sensor mounting design is that it allows vertical adjustments to be accomplished by horizontal movements. This is necessary since there is very little vertical room under the key for any mechanisms. On a piano all keys are tried to be made level or at the same height. However, it is difficult to do this any closer than several one-thousandths of an inch. For velocity and position detection it is necessary to position the sensors to within a few one-thousandths of an inch. Thus the sensors must be adjustable for each individual key. This is accomplished by using a "V"-shaped velocity slot in which horizontal movement of the LED sensor produces different slot widths and allows the velocity count to be adjusted for the individual key. Also the edge of the flag that is sensed by the key-played sensor is on an angle to the horizontal and therefore allows the detection of the key being played to be adjusted by horizontal movement.

The information gathered by these sensors is presented to the microprocessor by the sensor interface circuitry once per frame or every 28.5 milliseconds. The microprocessor then operated on this information and outputs to a recorder which keys and pedals are played and the composite bass and treble expressions of the keys according to our standard digital data format. From this master tape commercial cassette tapes are produced for consumer use.

The principal functions of the software are to input key play, key velocity, expression boost (8 bit switch) and add (4 bit switch) data, a frame extention value, and critical frame timing pulses, to operate on this data internally to form 128 bits (1 frame) of data every 28.5 msec., and to output this data for recording purposes on a digital tape deck.

The critical functions of the processor for creating quality output data are the development of the expression values and the key play information. In this system expression values are a direct function of key velocity and key play information and boost and add switch values. Key play data is dependent upon the key play inputs and the frame extension switch value. These two functions are discussed in more detail below.

BRIEF DESCRIPTION OF THE DRAWINGS

The above and other objects, advantages and features of the invention will become more apparent when considered with the following specification and accompanying drawings wherein.

GENERAL ORGANIZATION OF SYSTEM

Figure 1:
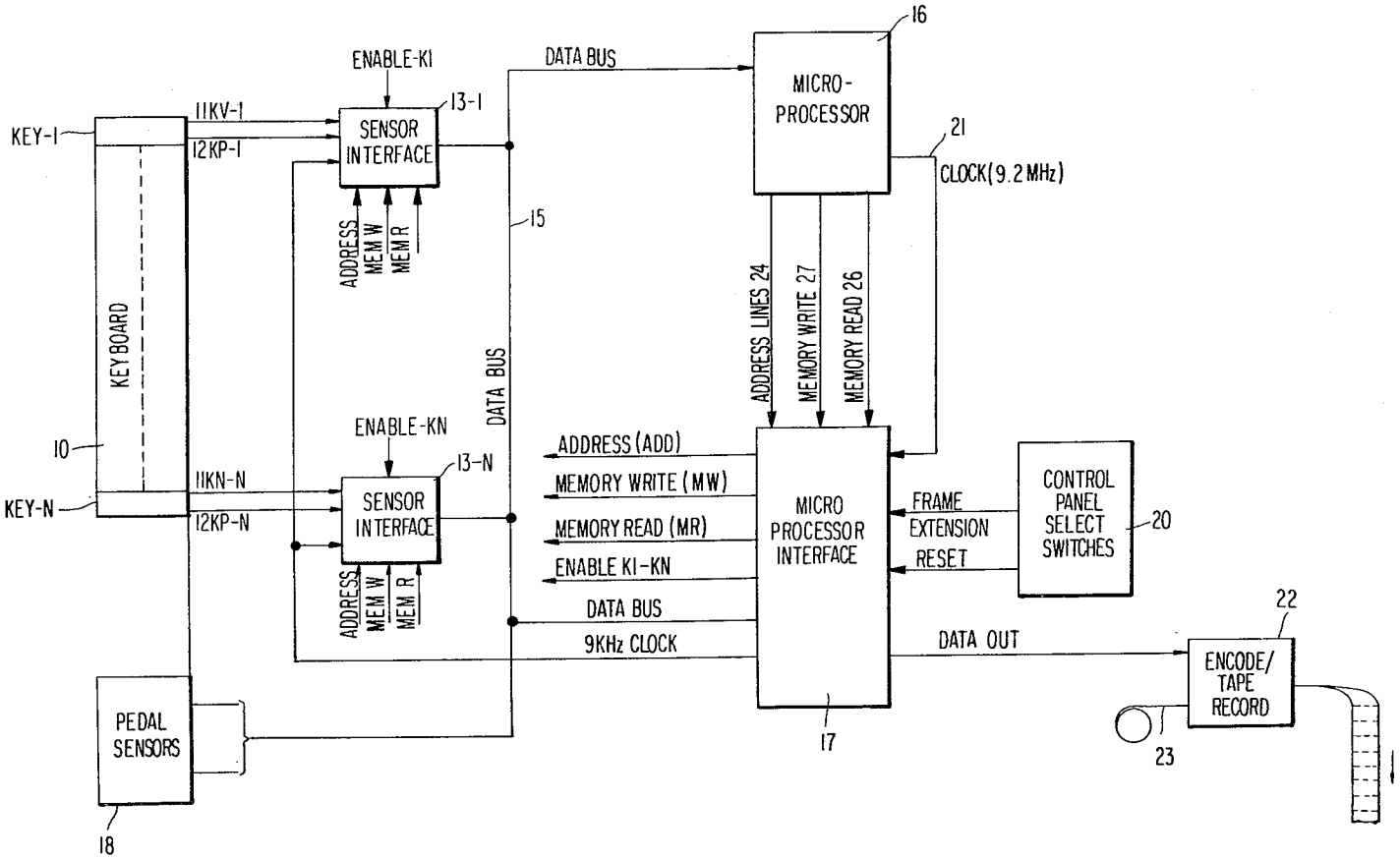
FIG. 1 is a block diagram of a master expression recording piano incorporating the invention.

Referring to FIG. 1, keyboard 10 of a piano is provided with key movement sensors (described more fully hereafter) which generate key played signals on line 11KP and key velocity signals on line 12KV. Each key has associated therewith an independently functioning key sensor interface circuit 13-1 to . . . 13-N (shown in detail in FIG. 3A), the output signals from the key sensor interface circuits being supplied to via data bus 15 to microprocessor 16 and interface circuit 17. Actuation of the foot pedals 18 (soft and sustain) of the piano actuate switches (not shown) to produce pedal signals which are supplied to the interface 17 and microprocessor 16. A set of panel switches 20 is used to supply frame extension, reset etc. signals to microprocessor interface 17 to modify the expression values and/or reset the unit for the playing by the musician of the next composition.

Figure 2:
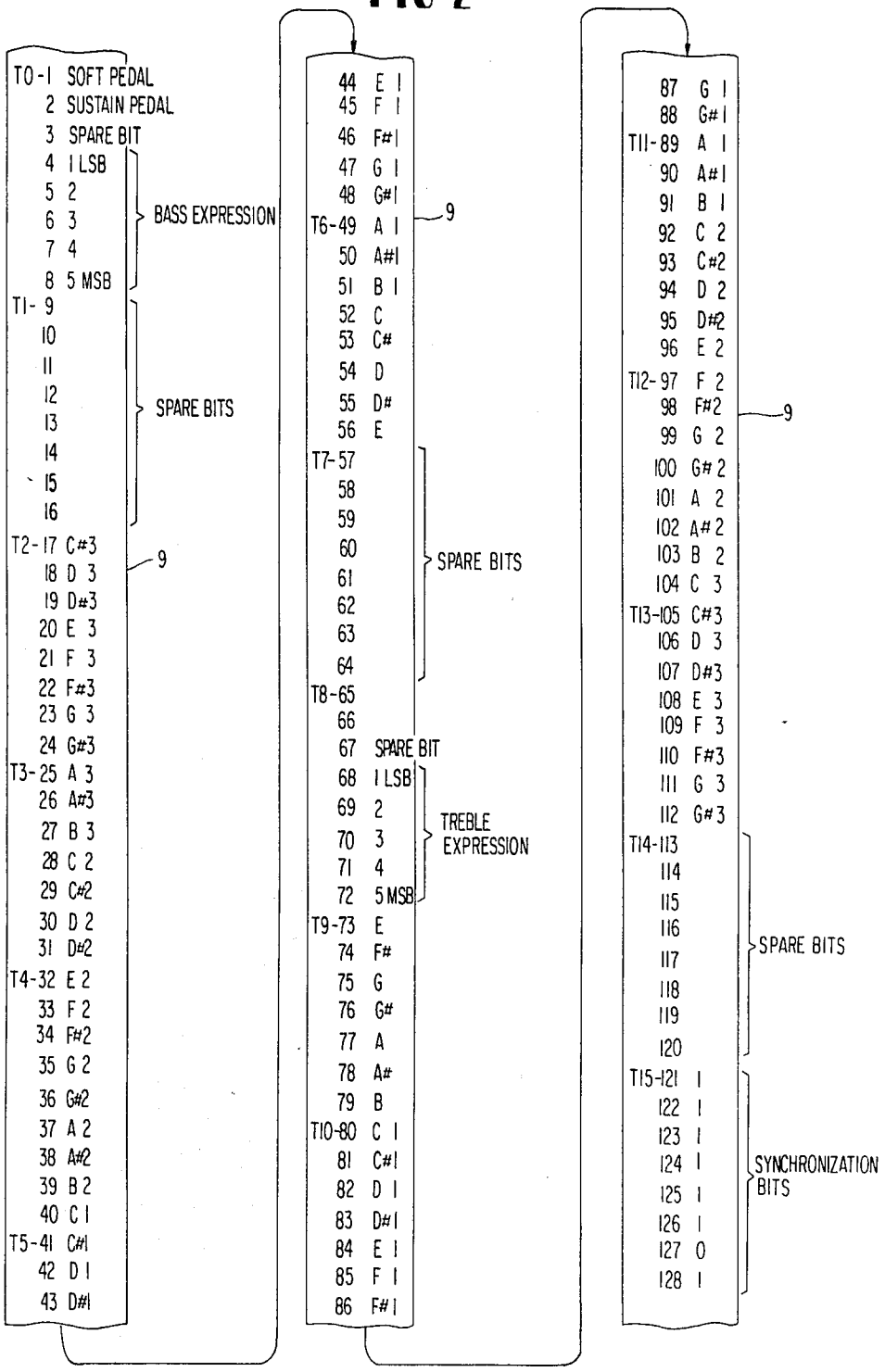
FIG. 2 is a chart illustrating the format of the frames of musical data cells or bits showing the bit assignments of the various piano key notes, expression, synchronization, spare bits, etc.

Time division multiplexed signal bits, having the format shown in FIG. 2, are outputted to an encorder/-tape recorder 22 (signals may, if desired, be encoded by microprocessor 16 or interface 17). A 9.2 MHz clock signal generated by microprocessor 16 is supplied on line 21 as supplied to interface 17 and thence to the sensor interface units 13 as a 9 KHz clock signal. The sensor interface circuits 13 are enabled in any desired sequence by enable signals from interface 17, which in turn, is controlled by microprocessor 16. Tape recorder 22 records the time division multiplexed data on magnetic tape 23, the frames of musical data being in sequential order on tape 23 from the tape recorder 22. Address lines 24 (sixteen for a 128 bit format) from microprocessor 16 are used by interface 17 to address and enable sensor interface circuits 13 in groups of eight. Lines 26 and 27 from microprocessor 16 provide memory read and memory write control signals to interface 17 which in turn supplies these signals to the sensor interface circuits 13 as described later herein. Conventional microprocessor-interface interrupt and acknowledgement signal lines have deleted for purposes of simplifying the disclosure.

KEY ACTUATION SENSOR STRUCTURE

Figure 3A:
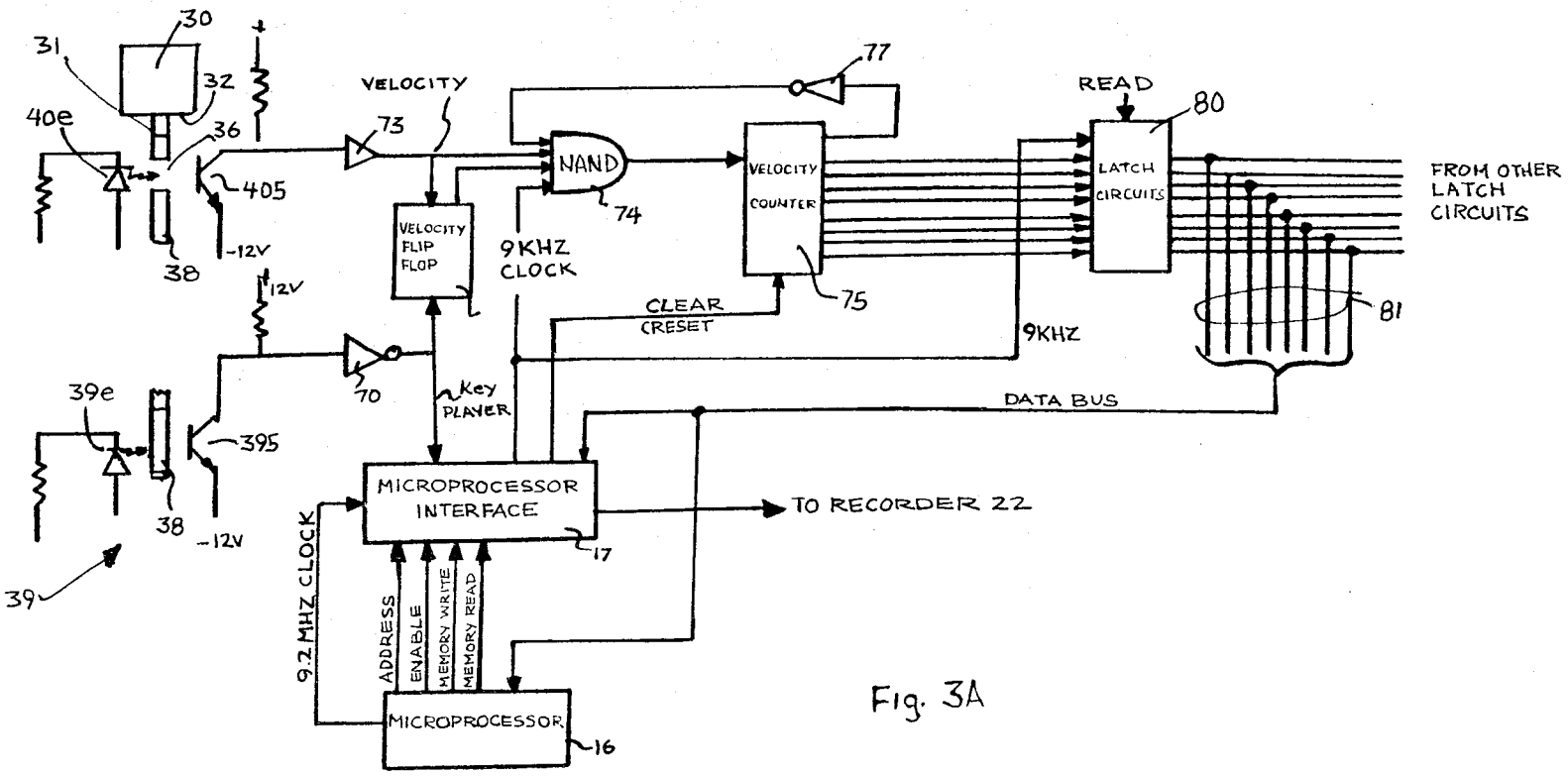
FIG. 3A is a partied schematic circuit diagram illustrating the details of the circuit for converting key played and key velocity to electrical signals, FIG. 3B illustates the waveforms and timing relationship of the circuit shown in FIG. 3A.
Figure 3B:
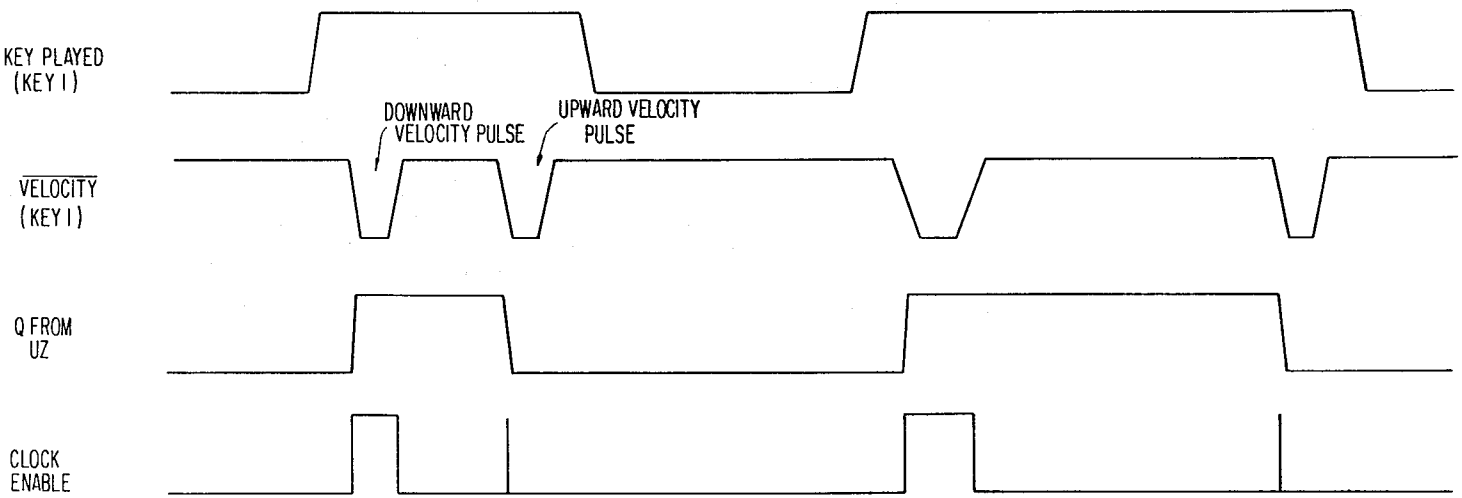
Figure 4:
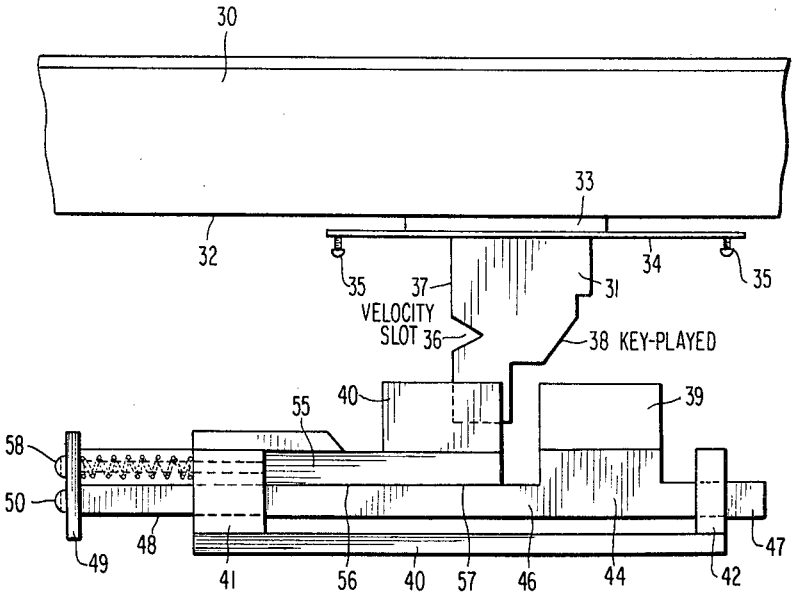
FIG. 4 is a side elevational view of one key and its associated key flag structure and photocell sensor mounting arrangement.

Referring to FIG. 3B, and FIG. 4 each key 30 has its own key sensor flag 31 secured to the underside 32 of each piano key and in the preferred embodiment, the flag has a flange 33 which is secured by spring bracket plate 34 and fasteners 35 as illustrated. Other means of fastening or securing flat 31 to key 50 may be utilized. Each flag 31 is a thin flat vertically oriented member, preferably of lightweight materials such as aluminum or plastic and, has, for use with the photosensors to be described later herein, opaque and non opaque portions the non opaque portion 36 in the left edge 37 of flag 31 is denoted herein as the "velocity slot" and the lower right edge 38 which is cut at a slanting angle is designated as the key-played edge. It should be appreciated that the opaque and non opaque roles of the component parts may be reversed without departing from the spirit and scope of the invention. A pair of sensors 39 and 40 are provided which in the preferred form are light emitting diodes and detectors and typically are designated as slotted optical switches commercially available from Optron Inc. of Carollton, Tex. and designated as their type OPB804 "slotted optical switch". In the arrangement illustrated, each of these units 39 and 40 has a slot through or between which the flag 31 passes in a substantially vertical direction as the key 30 is played or depressed by the musician. The left sensor is denoted the velocity sensor and the right sensor 39 is denoted the key played sensor.

Figure 5:
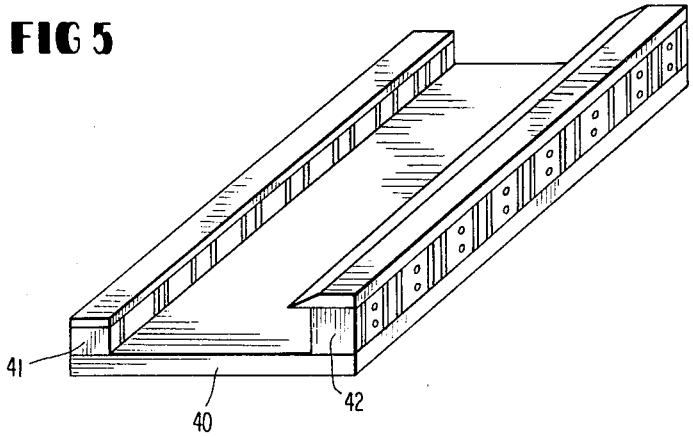
FIG. 5 is an isometric view of the key flag structure and photosensor mounting arrangement.

Each of the sensors is carried on its respective horizontally adjustable rail and, as shown in FIG. 5, banks of photosensors are carried in a common structure so as to facilitate their installation and adjustment. As shown in FIG. 4, a supporting plate 40 has secured at the lateral edges thereof slotted guide elements 41 and 42 which may be integrally formed with plate 40 or formed separately and secured thereto by fasteners not shown. The key played sensor 39 is carried on an up standing edge 44 or projection of key played rail 46, key played rail 46 having edge extensions 47 and 48 which extend in and beyond the slots 41S and 42S. For stability, there are pairs of key play rails for each key play sensor and each rail extends in its respective slots to where their outer most ends are joined by a coupling plate 49. A key play adjust screw and spring mechanism has a screw 50 which is threadably engaged with a threaded bore (not shown) in slotted rail guide 41. Thus, by turning the screw 50, the position of the rail projections 48 and hence the key played sensor 39 can be adjusted horizontally.

In like manner, a pair of velocity sensor rails 55 are mounted in sliding relation in the same slots that the corresponding key played rails slide and the lower edges 56 of the velocity sensor rails 55 are in sliding contact or abutment with the upperedge 57 of the key play rails. A similar screw and spring adjust mechanism is provided for the velocity rails 55. Thus, these rails slide back and forth upon each other when their respective screws are turned. These horizontal movements allow the velocity sensor and the key played sensors to be adjusted. Adjustment of the velocity sensor screw 58 allows a different width of the velocity slot to be selected and therefor allows tuning of the individual keys. Likewise, adjustment of the key played screw 50 varies the point at which the key play edge breaks the sensor light beam and tells the processing system (basically the microprocessor to be described fully hereafter) that the key is being played. The sensors are mounted in modules or banks of ten sensors and there are 8 banks of sensors for 80 keys of the piano, the outermost 4 keys on each side of the keyboard of an 88 key piano not being utilized in this embodiment. It will be appreciated that the flag design and sensing mounting structure in effect allows vertical adjustments to be accomplished by the horizontal movements of the sensor. This is necessary and an important feature of the invention since there is very little vertical room under the key for any vertical adjustment mechanism. On a piano all keys are tried to be made level or at the same height but it is difficult to do this any closer than several thousandths of an inch. For velocity and position detection it is necessary to position the sensor to within a few one thousandths of an inch. Thus, the sensors must be adjustable for each individual key and this is accomplished by structure shown where there is a "V" shaped velocity slot in which horizontal movement of the light emitting diode sensor produces different slot widths and allows the velocity count to be adjusted for the individual key. Also, the edge 38 of the flag 31 is sensed by the key played sensor 39 and is on an angle to the horizontal and therefore allows detection of the key being played to be adjusted by the same horizontal movement.

Sensor Interface Circuit

(FIG. 3)

In some prior art systems the composite expression (or intensity with which the musician strikes the piano keys) of key notes being played is detected by a microphone to produce electrical signals, the intensity of which is analyzed to produce digital signals corresponding to the expression information which is stored in a register, and then merged with stored frames of key note actuation data, encoded and recorded on magnetic tape for playback in player pianos vorsetzers and the like. See U.S. Pat. No. 4,174,652 assigned to the assignee hereof. Alternative systems have utilized various forms of key closer sensory arrangements including those for measuring the time between the actuation of a pair of switches by movement of the key as a measure of velocity and hence expression (U.S. Pat. No. 4,023,456). Still others have used very sophisticated resistance arrangements (U.S. Pat. No. 4,079,651) or light sensitive variable resistors (U.S. Pat. No. 3,835,235), changes in magnetic flux (U.S. Pat. No. 3,708,605). In U.S. Pat. No. 3,965,790, a light source and detector having a baffle moveable therebetween by a pedal is used for generating expression information proportional to the depth of plate depression, which adjusts the amount of light on the detector. In U.S. Pat. No. 4,121,490, a piston is coupled to the key and serves in a pnuematic transducer to provide an air stream having a velocity proportional to the force that the key is struck, the signal being utilized to approximate the touch of the musician upon a conventional piano.

The present invention utilizes the velocity of the key as a measure of the velocity of the hammer striking the piano string, in a simple and expedient manner such that it can be used to measure the velocity of 80 keys or more of a conventional grand piano. Prior systems were clumsy and difficult at best and required a rather complex mechanisms and lacked simple adjustments. According to the invention as discussed above, a thin metal flag 31 with edges of a slot or notch 36 is secured to the bottom 31 of the key 30 and utilized with a slotted optical light emitting diode (LED sensor and emitter) to produce an electrical pulse which indicates the period of time taken for the key to travel between two points in its downward motion. Pulses produced during the time travel between the two points are counted and utilized to access a lookup table in the microprocessor wherein are stored the different discrete levels of expression information.

The preferred format of the frame of information to be recorded on magnetic tape is illustrated in FIG. 2. As illustrated, there are 128 time slots in each repeating frame of data (and the data is recorded on the tape in time slots essentially as illustrated in FIG. 2), the assignments of data cells or time slots in each frame of a data has for example bit positions 4, 5, 6, 7, and 8 reserved for the bass expression information, slots or data cells 17–56 being reserved for the bass key note data, data cells or slots 68–72 being reserved for the treble expression information or word and time slots 73–112 being reserved for the treble key note data. Also disclosed are the time slots reserved for synchronization bits as well as the soft and sustained pedals, and a number of spare time slots which may be used for other storage of other control signals or information.

The sensor interface circuit or key is shown in FIG. 3A, it being understood that there is one sensor interface circuit for each key (and in an 80 key system there will be 80 sensor interface circuits). The wave form diagram shown in FIG. 3B for the sensor interface circuit should be considered in conjunction with the following description. As illustrated when the key is originally depressed, a key play signal is produced when slanted edge 38 (FIG. 4) moves between the emitter 39E of photosensor 39 and sensor 39S which applied to a Schmitt trigger circuit 70 the output of which is applied to velocity flip flop 71 and also to the microprocessor interface circuit 72. The $\overline{\text{velocity}}$ signal SHOWN in the wave form diagram of FIG. 3B is issuing from the velocity sensor 40 which has an LED emitter 40E and sensor 40S, and is applied to an amplifier inverter 73. The signal from Schmitt trigger inverter 70 is used to toggle the JK flip flop 71 at its clock input (the J and K inputs are tied to alogic one). The velocity flip flop circuit 73 thus, is reset at near the beginning of the key's downward movement by the key played signals shown in FIG. 3B. This signal is buffered by the Schmitt trigger 70 and applied to the reset input of the velocity flip flop 71. Thus, the first velocity pulse sets the Q terminal of the velocity flip flop to a logic 1. The Q output is then NOT ANDED or NANDED in gate 74 with the velocity signal to thereby enable the 9 KHz clock input to the NAND gate for the amount of time shown in the clock enable on the wave form diagram of FIG. 3B. When the key travels back to its rest position (in an upward direction) a second velocity pulse is generated and this pulse is used to clock the velocity flip flop 71 again and toggle it back to its reset state (where Q equals zero), thus, diabling the clock except for a small spike which allows a possible 1 extra count (out of 256 counts possible). Thus, this second velocity pulse is not measured by the circuit. The output of NAND gate 74 is applied to a velocity counter 75 which counts the number of cycles of a 9 KHz clock signal that occurs during the first or downward velocity pulse. Counter 75 is an 8 bit counter with a count of about 10 being the fastest velocity observed and a count of 256 being the slowest velocity observed which can produce no sound from a piano string. A key which is slower than a count of 255 (no sound) causes the inverter 77 connected between the counter's Q9 output and the NAND gate 74 to disable the NAND gate 74 and cease further clocking of counter 75. This prevents a velocity count of, for example 265 from rolling the counter over and counting to 10 thus recording a loud note when no note occurred. Therefore, 256 is the highest possible count. The velocity counter's output is latched in a tristate latch circuit 80 and then supplied on the data bus 81 to a microprocessor circuit 16. The microprocessor 16 reads the count at the output of the latch circuits 80 with the $\overline{\text{read}}$ signal and clears the counter 75 after reading with the clear (clr) signal. The microprocessor 82 reads the count at the output of latch circuits 80 (as each is enabled and addressed via interface 17) with the $\overline{\text{read}}$ signal and clears the counter 75 after reading with the "clear" signal. The microprocessor 82 reads the counter when it detects the $\overline{\text{key played}}$ signal. After a $\overline{\text{key played}}$ signal becomes true, the microprocessor 16 reads the $\overline{\text{key played}}$ signal each frame and records the note as being played until the signal goes away. Thus, the information gathered by the velocity and key played sensors is presented to the microprocessor 16 by the sensor interface circuitry 17 once per frame or every 28.5 milliseconds. The microprocessor 16 then operates on this information and outputs the information via interface 77 to encoder/tape recorder 22 which records composites the bass and treble expressions of the keys according to the format illustrated in FIG. 2. From this, master tape commercial cassette tapes can be produced for computer use with the tape control player piano use illustrated in application Ser. No. 828,069.

The processor system utilized for gathering the key velocity and key play information, processing and formatting the data and then outputting the data to taperecorder 22 is an Intel, Corp. single board computer (SBC 80/10). This board employs an Intel 80/80 microprocessor as a central processing unit. The principle functions of the programing installed in the 80/80 microprocessor are to input key play, key velocity, expression boost (8 bit switch) and add (4 bit switch) data, a frame extension value, and critical frame timing pulses to operate on this data internally to form 128 bits (1 frame as illustrated in FIG. 2) of data every 28.5 miliseconds and to output this data for recording purposes on a conventional digital tape deck. It will be appreciated that various other forms of encoding and data formats may be utilized but with the principles of the present invention.

The following description is of the operation of the microprocessor in terms of a 16 frame music data buffer and is illustrated for purposes of explanation in FIG. 6A through FIG. 6K.

In the actual embodiment, there are ten circuit cards, each card carrying eight sensor interface circuits 13. Each card receives an address signal unique to it (these are in the "address" (add) line from microprocessor interface 17) and a further three bit address signal which locates the particular interface sensor circuit, and then an enabling signal, the memory write and memory read signals being read or scanned at that time. However, soley for purposes of simplifying the discosure the eight sensor interface cards are not shown and in FIG. 3 the selection circuits which decode the address, enable, memory read and memory write signals from microprocessor 16 via interface 17 are not illustrated as these circuits are in all ways conventional. To the extent necessary for a full understanding of the invention such signals are diagrammatically indicated in FIG. 3. The synchronization word (bits 121–128) and other control bits may be added to each frame by the microprocessor.

EXPRESSION ALGORITHM

Although each key 30 has its individual velocity information obtained by the microprocessor 16 from external hardware counters, the data must sill be condensed to conform to the data format illustrated in FIG. 2. As shown, this format calls for two expression values or words per frame of data, these values or words being five bit binary codes (32 levels), one each for the bass and treble key sections. Since these two values or words are derived identically, only one need be discussed in detail.

An expression value or word is placed in each frame of data for both the treble and bass key notes, but a new value is calculated or derived for only two conditions. The first condition for determining a new expression value is when one or more new keys is depressed within a given frame time. Internally, in the micriprocessr 16, a new key is defined a "0" to "1" transition of the key play data. When this condition is met, the velocity counter 75 for each new key 30 during that frame is collected and these velocities are then used as pointers into a predefined lookup table in a microprocessor 16, that correlates key velocity to an expression value from 0 to 31. For each new value there is determined an expression level, each expression level thus determined being stored in sequence in a memory table. The number of new keys or new expressions for both treble and bass tables is thus stored in a working section of the microprocessor memory.

Figure 6A:
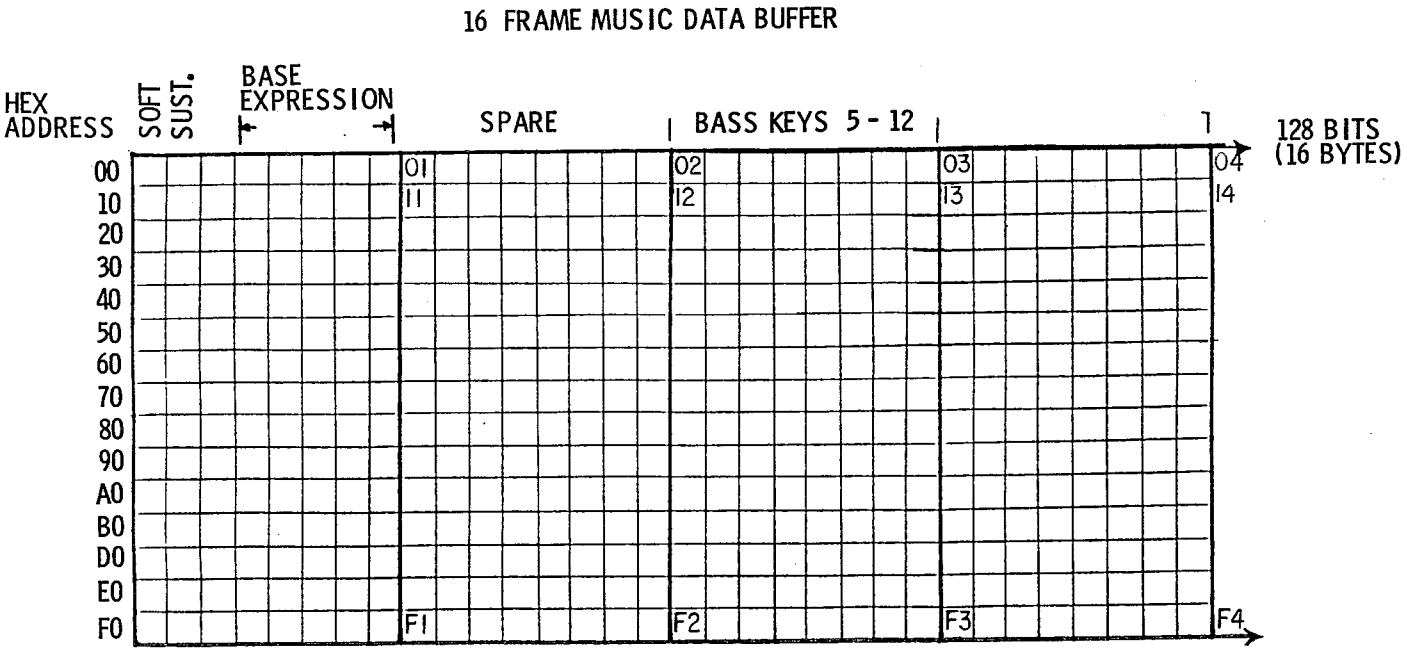
FIG. 6A through 6K illustrate the sixteen frame musical data buffer for purposes of providing a clear understanding of the operation of the microprocessor.
Figure 6B:
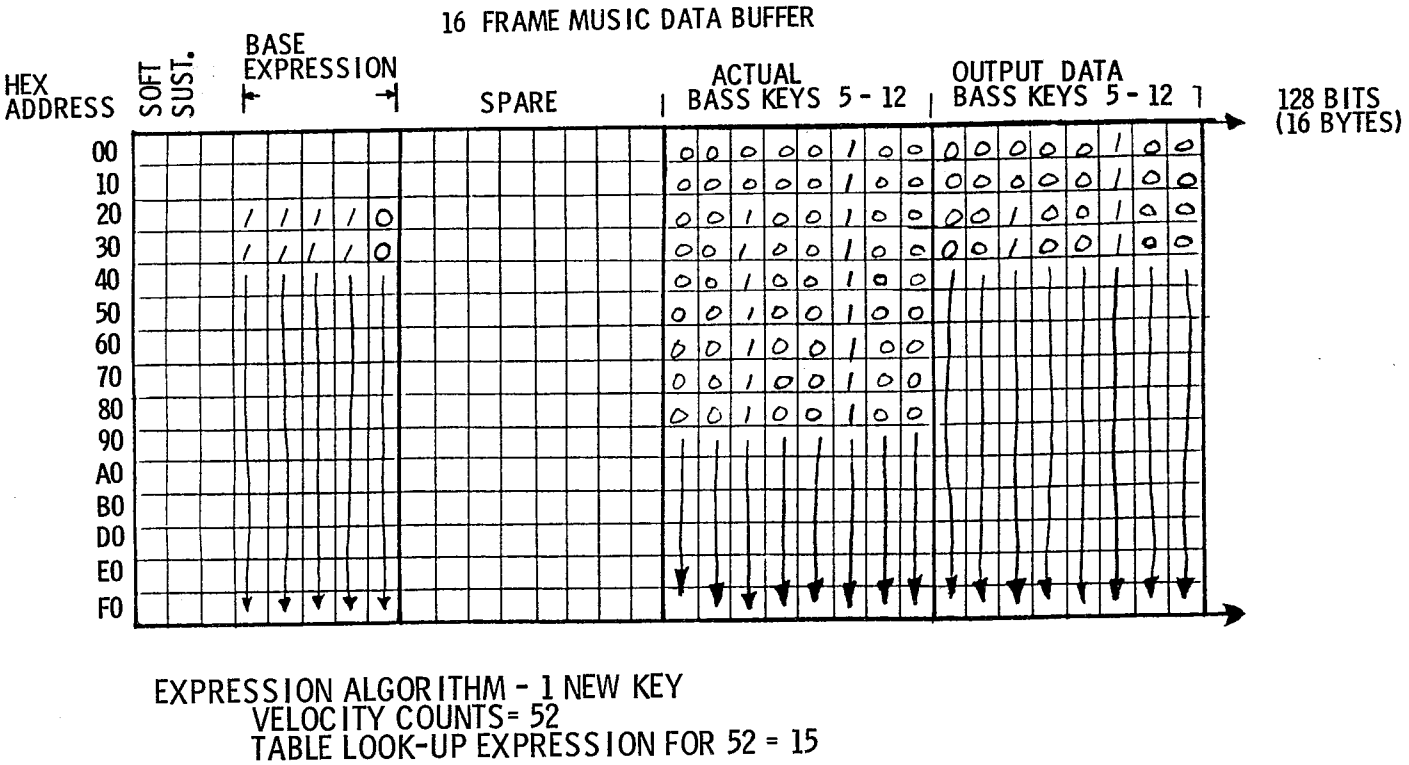

When the number of new keys is "one" then that expression value saved in the table is passed on as the expression value based on the key velocity. Otherwise, the microprocessor, via the expression algorithm, must try to combined two or more values into a single composite value. In either case, that value is not necessarily the final one, but a value based soley on key velocities. The value is further revised by the boost and add switches on control panel 20 coupled via the microprocessor interface circuit 17, and certain types of key play data, denoted "trills" herein, which are discussed more fully hereafter. FIG. 6B discloses the expression algorithm where one new key has been played.

If more than one key is detected in a given frame, then a median value approach is utilized to determine the composite expression value or word should be. In order to determine a median value, the expression value for the keys stored or listed in the tables are ranked in numerical order, smallest to the largest. When this has been accomplished, a median value is easily determined. In order however to take care of situations where one group of keys are played softly and another group louder, the median value routine becomes more involved. An external presettable switch on the control panel 20 designated algorithm number is used so that this grouping can be determined as follows:

1. If there were new keys and therefore a new expression value in the previous frame or if not two adjacent values in ranked table differ in value by more than the discrete level or algorithm number, then one median value is determined.

The median value=The median of all values in the ranked table.

2. Otherwise, two median values are determined;

(a) high median expression=a median value of all values above and including the higher of the two adjacent values which differed by more than one discrete level or algorithm number.

(b) low median expression=the median value of all values mentioned above.

Figure 6C:
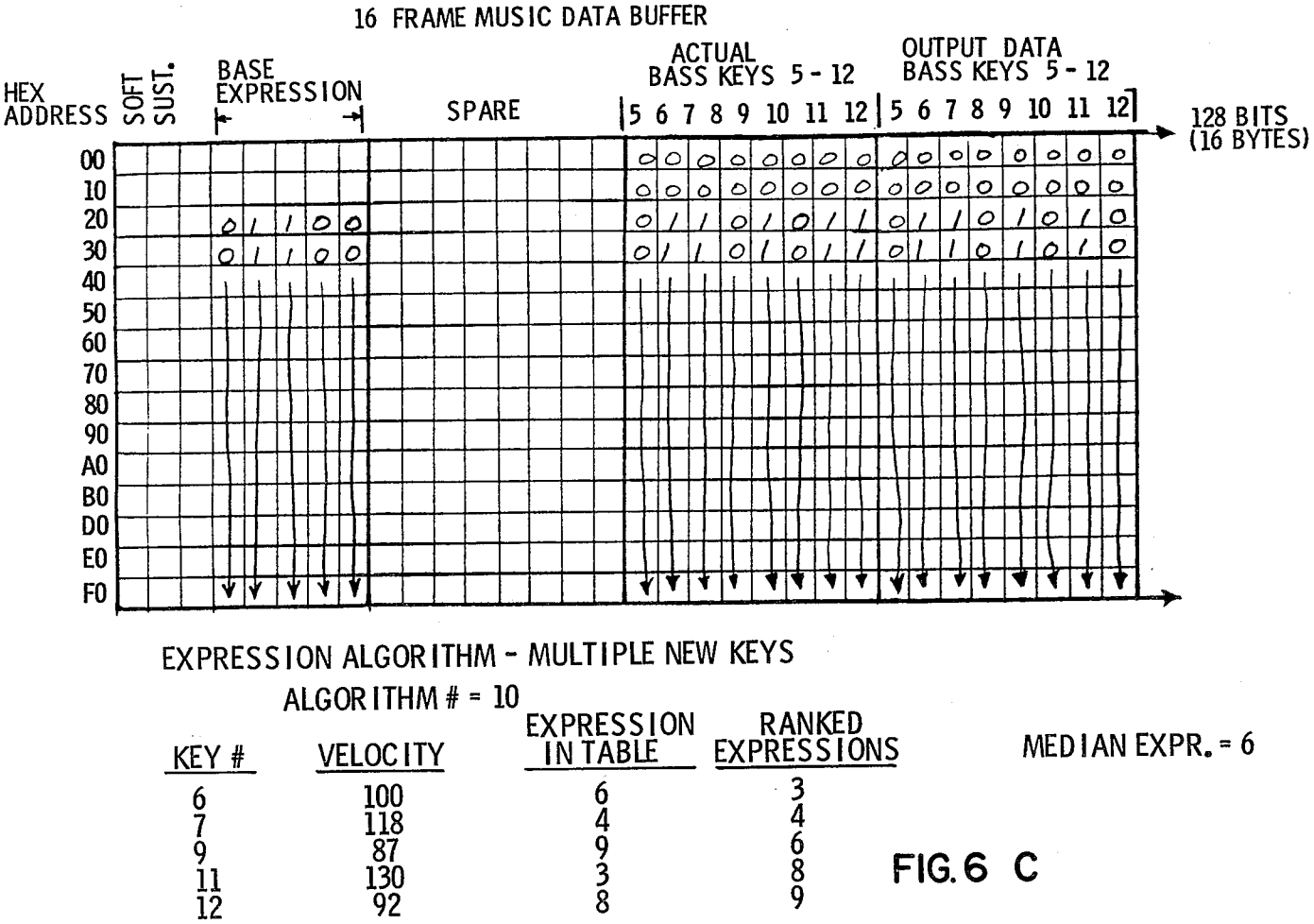
Figure 6D:
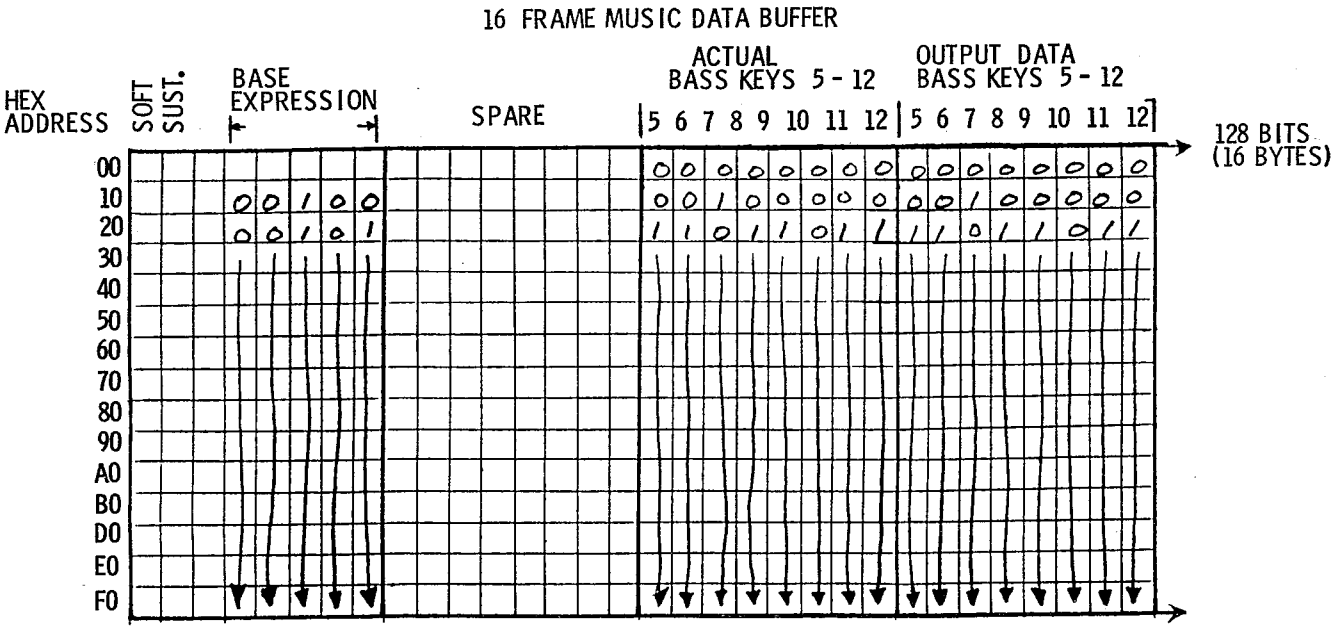
Figure 6E:
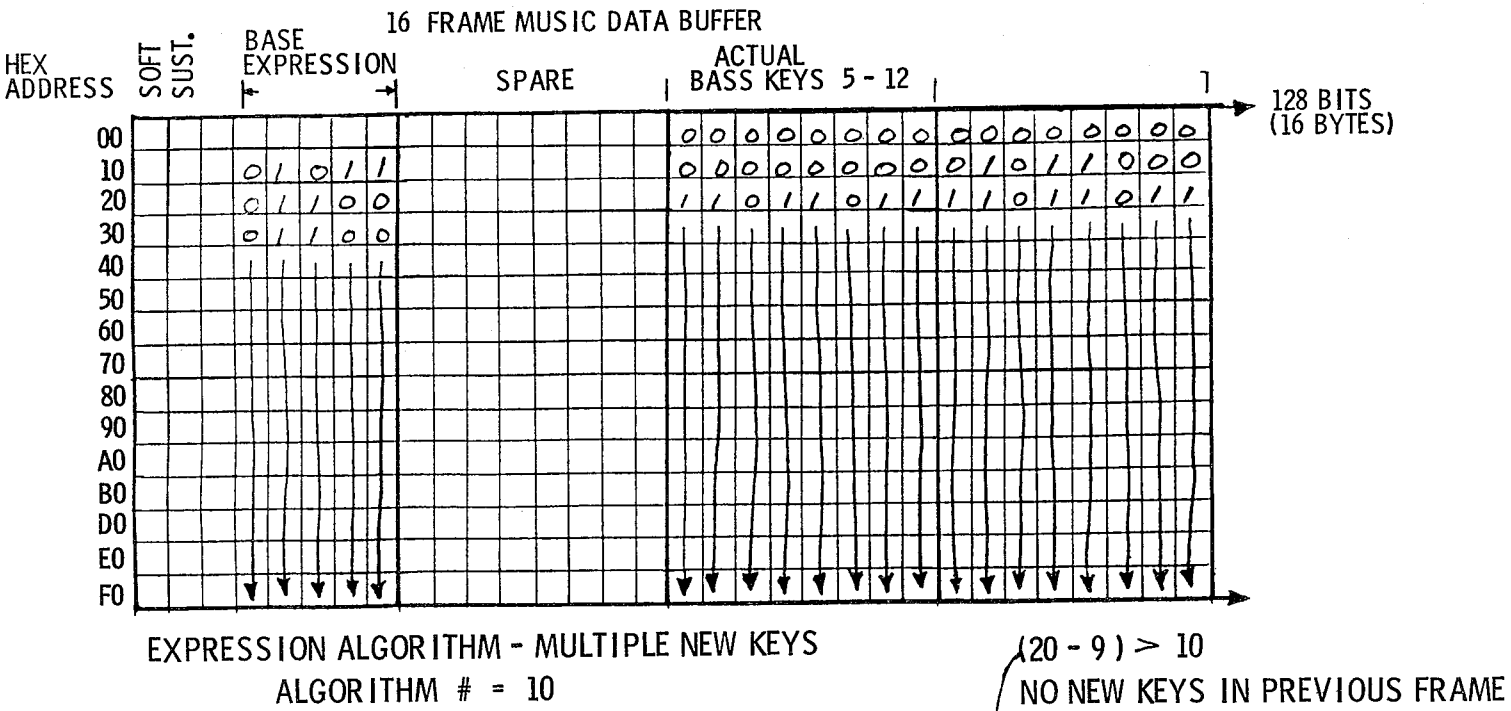
Figure 6F:
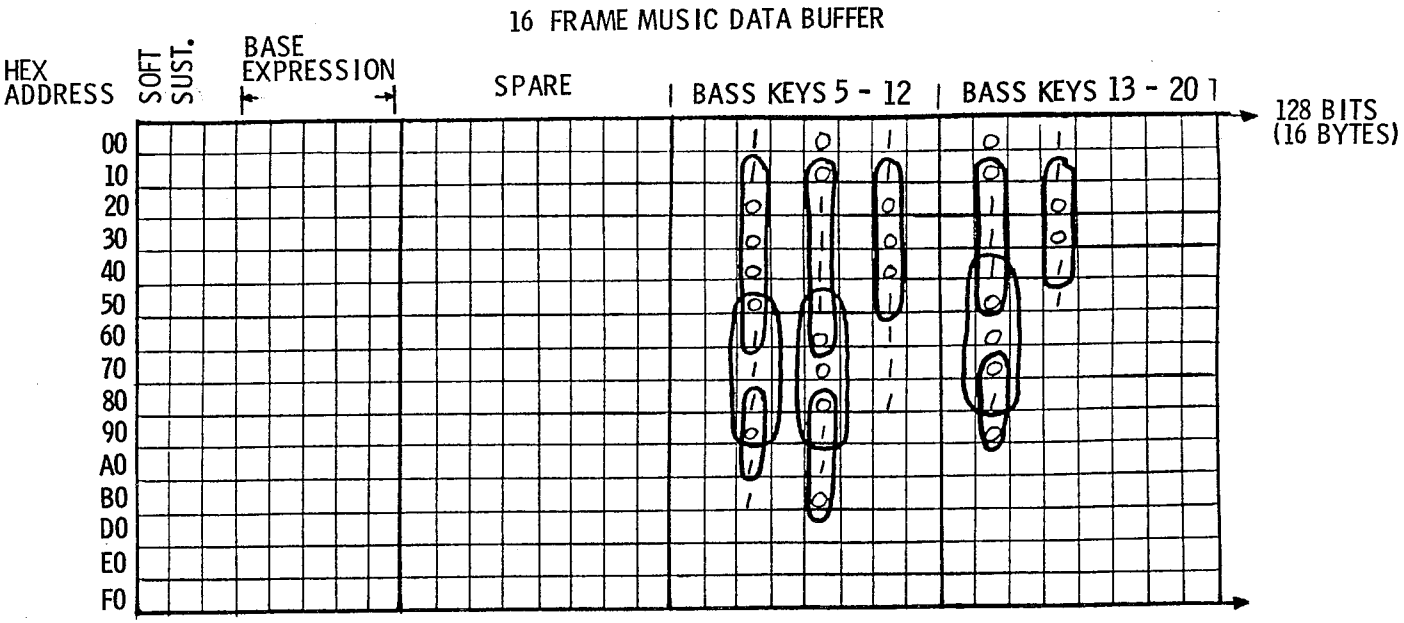
Figure 6G:
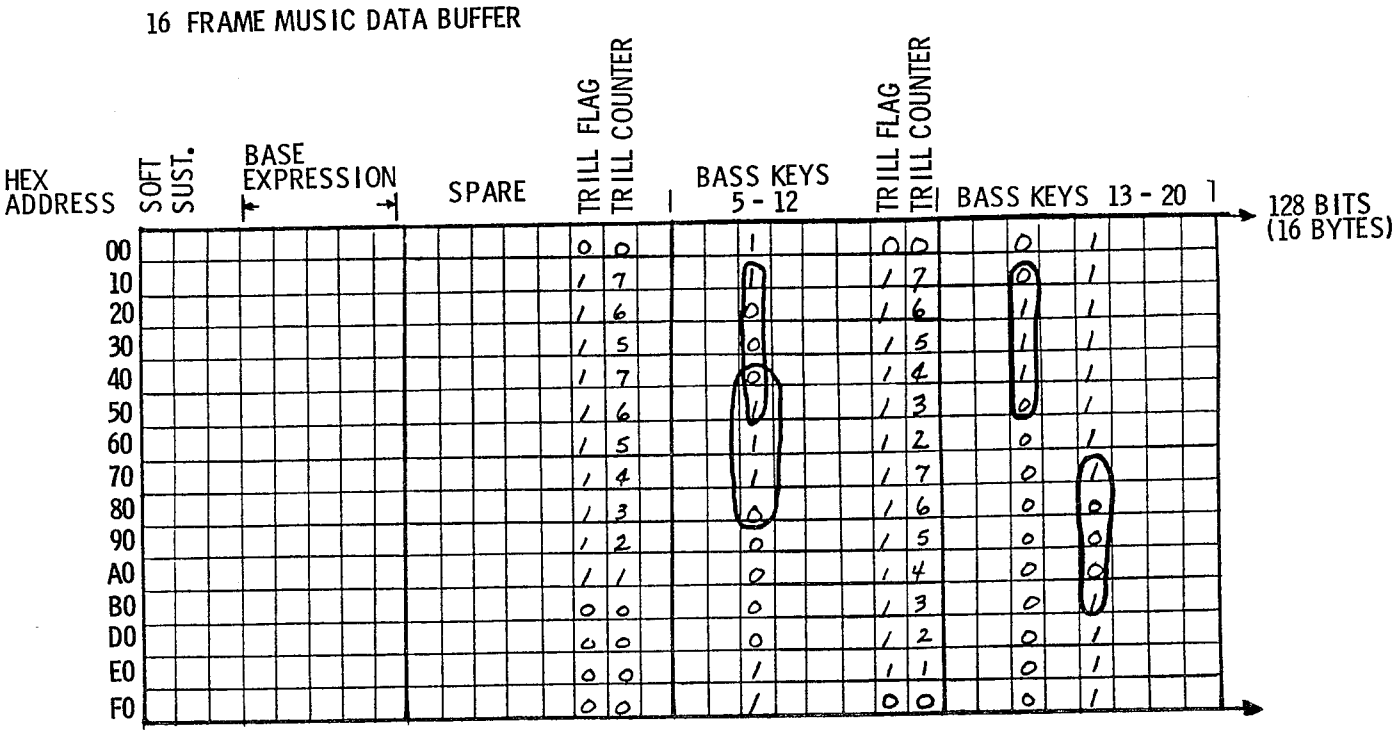
Figure 6H:
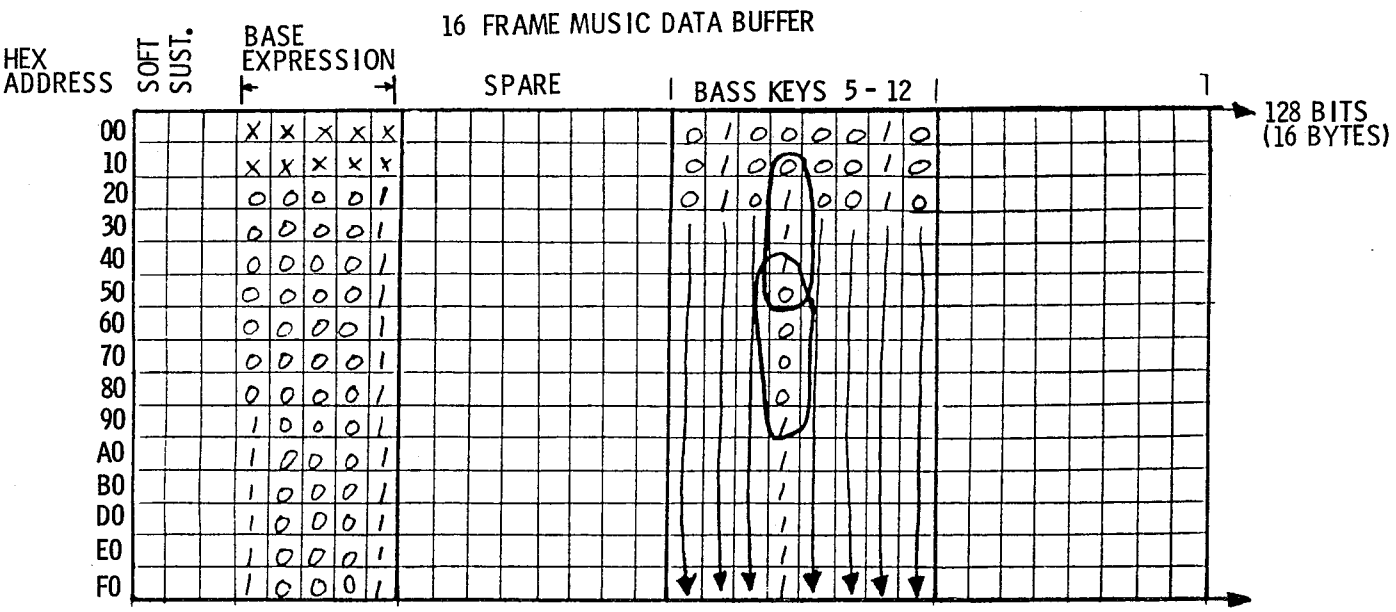
Figure 6I:
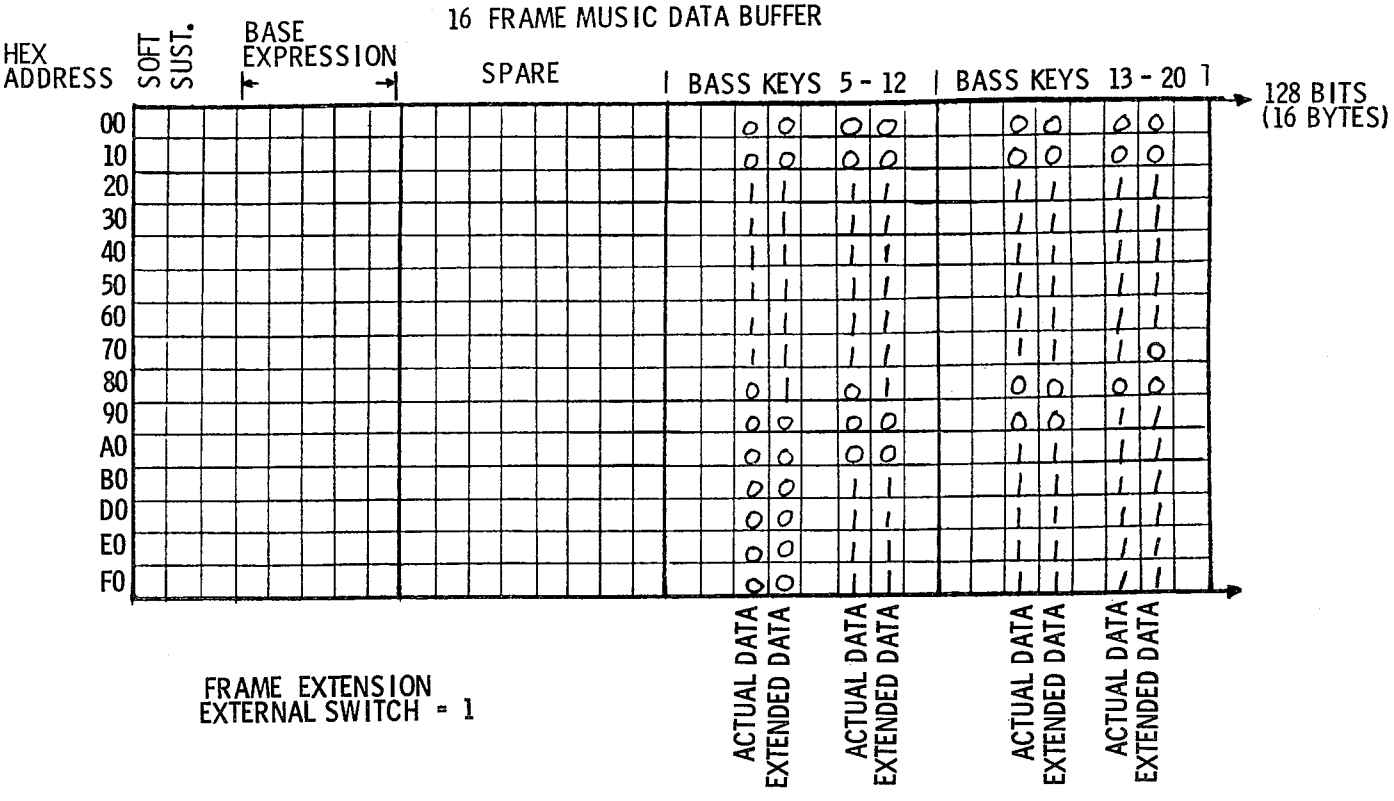
Figure 6J:
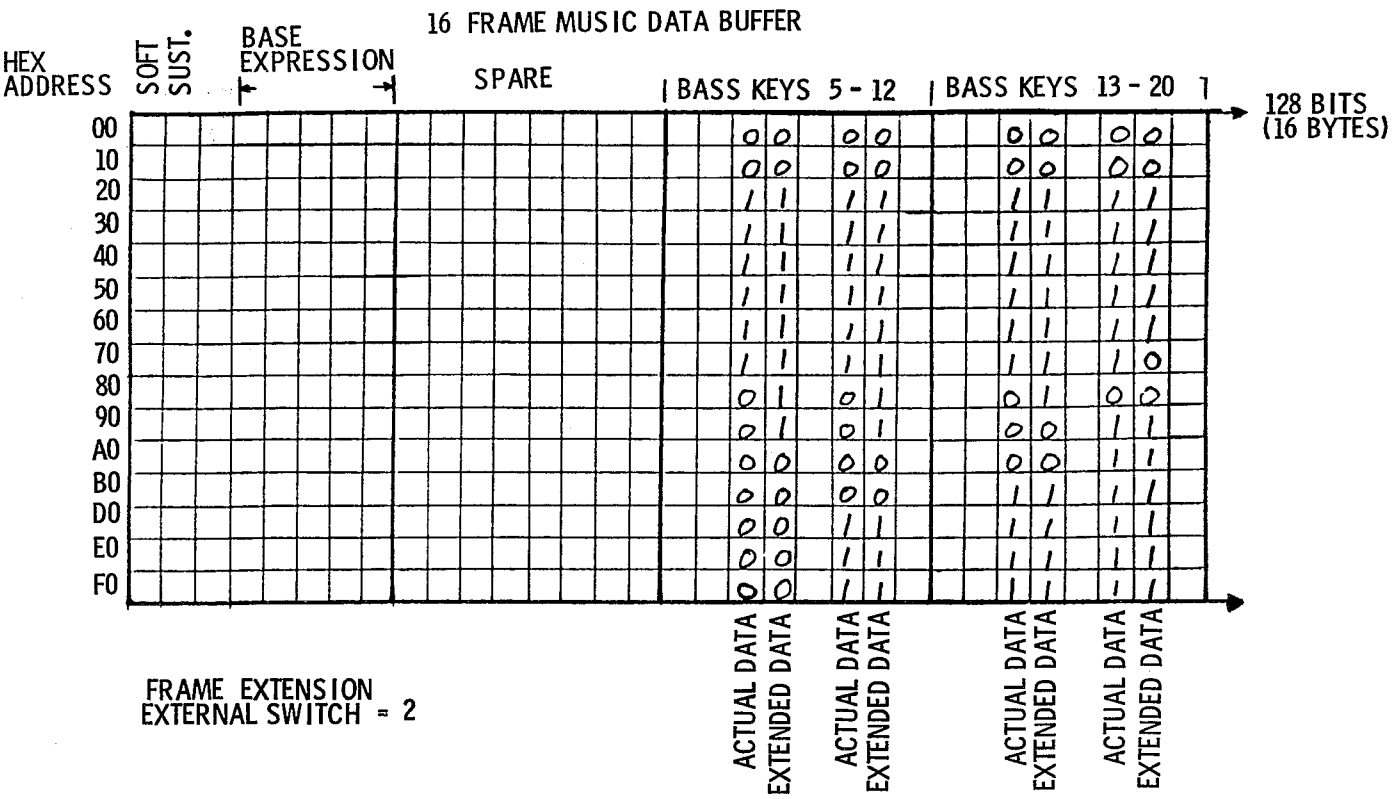
Figure 6K:
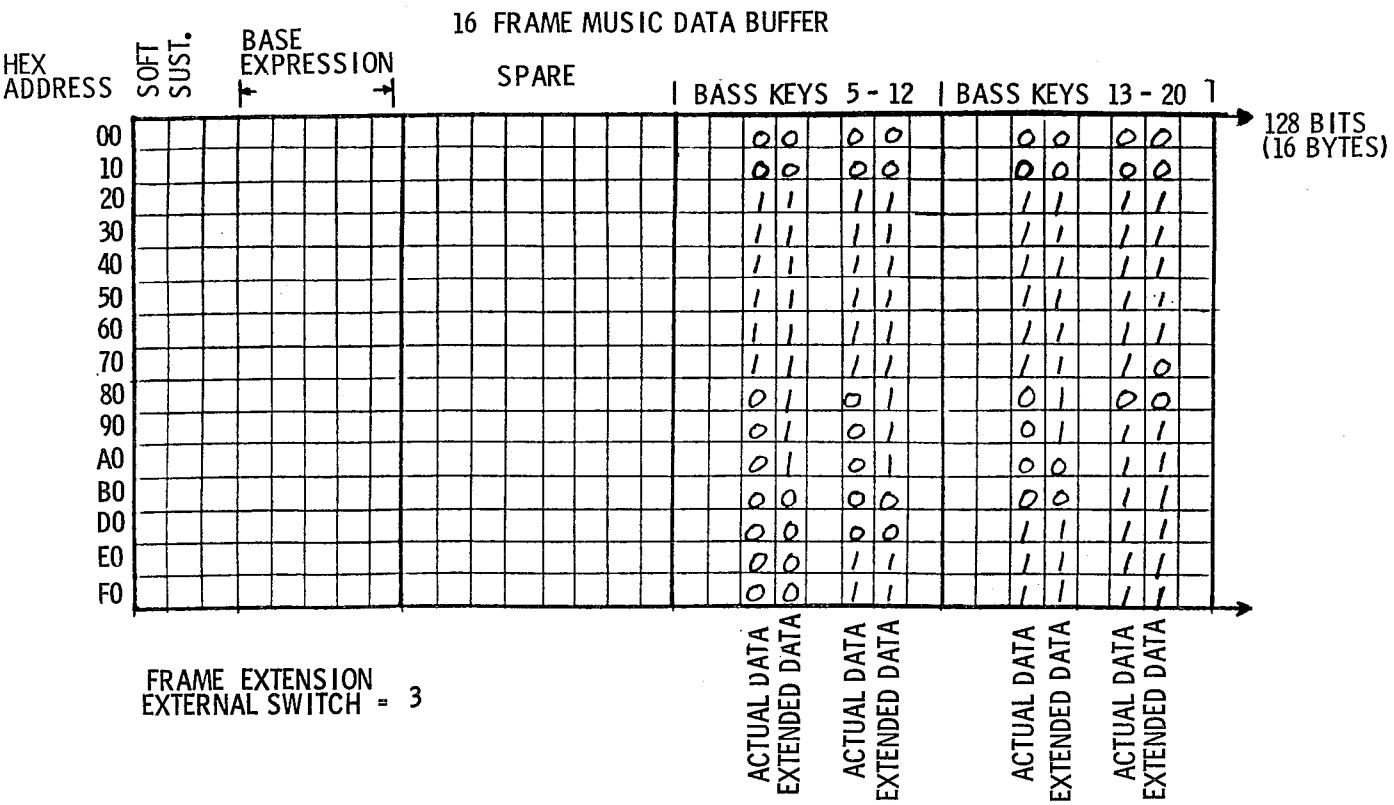

This is diagramtically illustrated in relation to the music data buffer exemplarily illustrated in FIGS. 6C, D, and E.

Not that if two median values are determined, the high value is used as an expression value for the previous frame data. In addition, those new keys that were in the upper grouping are pulled ahead to the previous frame as if they were played one frame earlier. This in effect emphasizes those keys by playing them earlier with a higher expression level. The low median expression value in those keys in the low group are used as the data for the present. If only one median value was determined then it is the expression use for the current frame. In either case, this expression value is used in conjunction with the parameter discussed below for determining the actual expression that is ouputted for the present frame for taperecording purposes.

BOOSTING

The boost parameter is utilized to allow for the first frame of a new key or keys to be played at a higher expression because this will allow for better inertial movement of the solenoid, especially on softly played notes. A four bit switch (0–15) on the control panel is used to determine which values are to be boosted. Values which are lower than or equal to the switch value are boosted while values above the switch value are left alone. If the value is to be boosted, the value used as the expression for the first frame is read from another 4 bit switch (0–15). The original expression value is saved or stored for used in subsequent frames.

ADDING (TRILLS)

Trills are short fast repetitions of a particular note, (for simplicity, a trill is defined as any short "on" or "off"), and it is harder for the solenoid in the playback piano or vorsetzer to respond to this data accurately and, the expression is especially critical. One way of improving the performance is to increase the expression during trill music. According to the invention, a special routine is executed each frame time to analyze the data stream and determine if any trills are being played. That is, is there are any short "on" or "off". See FIG. 6E. If a trill is in process, then the routine sets a flag or (a trill signal is generated) which is checked by the microprocessor. The trill flag must be set and the initial expression be less than 16 for the adding process to take place. If both conditions are met then the 4-bit add switch is added to the expression value. In order to allow the microprocessor to do an automatic trill detection, an internal music buffer is utilized. To allow for frame extension, maximum velocity counts, and the trill detection, a frame buffer (as indicated in FIG. 6A to FIG. 6K) is utilized. Therefore, the data being outputted at any particular time lags the actual input data by 16 frames. The trill detect routine utilize 5 of the frames preceeding the output buffer to perform the trill detection.

Each note and its data is analyzed independently of the remaining 79 notes (there would be 87 notes if all keys of the piano were utilized). Four frames or less is the period that the microprocessor is programed to detect. Looking at a six frame time period for four frame on or on-off-on transistions within these six frames. When either of these conditions are met, the trill flag (trill signal) is generated and set so that the expression will be increased. This flag or trill signal will remain set for seven frames (see FIG. 6G) after any new trill is detected. If a second trill is detected before seven frame of the first trill have been completed, then the trill flag will stay on from the beginning of the first trill to seven frames after the beginning of the second trill.

FRAME EXTENSION

Extension of a note beyond the actual played time allows for smoother quality sound (see Campbell application Ser. No. 828,069). However, a real problem arises when trying to extend notes when trills are being played. Since the key play data is very critical with trills, modifying the data of any note being trilled greatly affects its sound and in the case of an extension may wipe out the off time of the trill completely as the sounding of a trill on play is lost. Therefore, special treatment is given to key play data whith short off times. An external switch on the control panel is provided for selecting 1, 2, or 3 frames of extension. It will be appreciated that by utilization of a different switch the selectable range can easily be broadened. The basic concept of the routine is to extend all notes by the number of frames indicated by the preselected switch except for notes with short off times.

To handle notes with short off times, the microprocessor is caused-to look ahead at the data before extension. To insure enough off time for a solenoid to respond properly, at least two frames of "0" data are needed. If according to the key played data and the extension switch, a note should be extended but only two frames of "off" time remain in the data, then the micro-processor does not apply the extension. An important feature that is easily added as a result of this concept is termed "reversed extension". This concept of insuring that there are always at least two frames of "0" data when an off is detected also applys to the actual data that has only one frame of "off" time before extension is considered. In this case, the last "on" frame is zeroed out thus making the "off" time two frames. Since solenoid off time is more critical than "on" time, the quality of trill music is enhanced by the process.

While there has been shown and described a particular embodiment of the invention, it will be apparent to those skilled in the art that numerous modifications and variations may be made in the form and construction thereof without departing from the more fundimental principles of the invention. Therefore, it is intended to include within the scope of the invention all modifications and adaptations readily apparent to those skilled in the art.

What is claimed is:

1. In a keyboard musical instrument having a plurality of keys arranged for manual manipulation by a musician, the improvement comprising a plurality of key flags, one for each key on the keyboard, means mounting each key flag on the underside of its associated key for substantially vertical movement therewith, a plurality of photocell sensor means, there being at least one photocell sensor means for each flag, each photocell sensor means having a light source for projecting light across a path and means on the opposite side of said flag from said light source for detecting flag movements in said path, each flag having an opaque portion and a transparent portion, there being at least one straight line of demarcation between said opaque and non-opaque portions, said straight line of demarcation being at an angle other than horizontal or vertical, and means for supporting each said photocell for independent horizontal adjustment relative to the path of movement of said at least one straight line of demarcation on its corresponding flag to cause in effect a vertical adjustment of each key by a horizontal movement of its related sensor.

2. The invention defined in claim 1 including a further plurality of photocell sensors, at least one further line of demarcation between opaque and transparent portions of said flag, one of said further plurality of photocell sensors being associated with each flag for sensing initial movement of said one further line of demarcation thereof and producing a key played signal, and means for supporting each said further said photocell for independent horizontal adjustment in a plane parallel to the plane of adjustment of said first photocell sensor and relative to said further line of demarcation.

3. The invention defined in claim 1 wherein said transparent portion is a notch in said flag having at least two edges, each said edge constituting a line of demarcation translatable past the photocell sensor associated therewith and producing an electrical signal corresponding to the movement of said flag edges therebetween, and an electrical circuit coupled to receive electrical signals from said photocell to determine the time interval between sequential movement of said two edges past said photosensor.

4. The invention defined in claim 3, wherein said electrical circuit includes a source of fixed frequency pulses, an electrical pluse counter connected to receive said pulses, means coupling the electrical signals corresponding to the initial sequential movement of said flag edges respectively, to said counter to initiate and terminate, respectively, the counting of said fixed frequency pluses during said time interval, means for translating the count in said counter to signal contituting expression signal for the key when played by the musician, means coupled to said key for producing key played signal corresponding to the key played, microprocessor means for translating the expression signals for all played keys to a common expression signal for said played and keys, and means recording said common expression signal with said key played signals.

5. The invention defined in claim 4 wherein said means coupled to said keys for producing key played signals comprises a futher plurality of photocell sensors, at least one further line of demarcation between opaque and transparent portions of said flag, one of said further plurality of photocell sensors being associated with each flag for sensing initial movement of said one further line of demarcation and producing said key played signal.

6. In a piano having a piano key board, apparatus for sensing the force with which a piano string is struck by a piano key operated hammer comprising, a flag member coupled for vertical movement with piano key, sensing means adjacent each said flag member, said flag having a structural formation for generating electrical signals in said sensing means in the absence of physical contact therewith, including a first signal corresponding to movements of said flag and a second signal corresponding to movement of a fixed point on said flag past a reference point in space, and a third signal corresponding to movement of a further fixed point on said flag member past said reference point, and means activated by said first signal for determining the time period elapsed between the generation of said second and said third signals.

7. The invention defined in claim 6 wherein said sensing means is constituted by a pair of photocells.

8. The invention defined in claim 7 wherein said structual formations are constituted by a pair of edges at angles other than horizontal and vertical, said sensors are moveable relative to each other and said edges in a horizontal plane.

9. The invention defined in claim 8 including a mounting structure for said photocell sensors comprising, a pair of spaced apart parallel guide members, each said guide member having at least one guide slot, for each piano key, a first photosensor carrier rail supporting a first one of said pair of photosensors, a second photosensor carrier rail supporting the second one of pair of photosensors said first photosensor carrier rail means sliding in both of said pair guide slots, and supporting one of said photocells, said second photocells carrier rail means sliding in one only of said pair of guide slots and on an upper edge of said first carrier rail means, and supporting the other of said photocells, and means coupled to one of said guide members for independantly adjusting the horizontal position of each said photosensor carrier rails.

10. In a player piano system in which the key note data is stored on magnetic tape in time division multiplexed frames of data with expression effect information for controlling electrical signals delivered to the solenoids for actuating same as stored in said time division multiplexed frames of data, the improvement comprising means for increasing the expression effect in the first frame of data in which the new key or keys are played so as to provide for enhanced initial movement of the solenoids actuating the selected keys of said piano.

11. In a device having a magnetic tape for controlling the key operating solenoids of a player piano, wherein the expression signal bits and key operating signal bits are stored on said tape in a time division multiplexed sequence of frames of data recorded on said tape, the improvement wherein the initial frame of data of the sequence of frames of data in which the key operating signal bits of new key or keys are to be stored has the expression signal bits corresponding to an increased expression signal recorded therein to thereby provide improved initial movement of said key operating solenoids.

12. In an apparatus for recording the manipulations of the keys of a keyboard musical instrument including sensor means for sensing the actuation of each key of the keyboard instrument and means for scanning said sensors and providing time division multiplexed frames of key note data containing the actuations of said keyboard and the intensity with which said keys were played by the musician, the improvement comprising, means for storing a plurality of said frames of key note data, means for detecting the existence of a trill in said stored frames, and means for extending the expression to at least seven frames after any new trill is detected.

13. The invention defined in claim 12 wherein said first selected short number of frames is four and said second selected short number of frames is six.

14. The invention defined in claim 12 including means for extending the key note data of all notes played, except for said trill notes, a selected number of data frames.

15. The invention defined in claim 12 including means for insuring that for notes to be played, there are always at least two data frames following the note to be played in which there is no key note data.

* * * * *